US010246171B1

(12) United States Patent
Beebe et al.

(10) Patent No.: US 10,246,171 B1
(45) Date of Patent: Apr. 2, 2019

(54) FLOATING VESSEL CARGO OPTIMIZATION SYSTEM

(71) Applicants: Anthony Beebe, Houston, TX (US); Jose H. Vazquez, Houston, TX (US)

(72) Inventors: Anthony Beebe, Houston, TX (US); Jose H. Vazquez, Houston, TX (US)

( * ) Notice: Subject to any disclaimer, the term of this patent is extended or adjusted under 35 U.S.C. 154(b) by 0 days.

(21) Appl. No.: 16/171,104

(22) Filed: Oct. 25, 2018

(51) Int. Cl.
*B63B 45/04* (2006.01)
*B63B 45/00* (2006.01)

(52) U.S. Cl.
CPC ..... *B63B 45/04* (2013.01); *B63B 45/00* (2013.01); *B63B 2201/00* (2013.01); *B63B 2201/04* (2013.01)

(58) Field of Classification Search
CPC ... B63B 45/00; B63B 45/04; B63B 2045/005; B63B 2201/04; B63B 2201/08
See application file for complete search history.

*Primary Examiner* — Benyam Haile
(74) *Attorney, Agent, or Firm* — Buskop Law Group, P.C.; Wendy Buskop

(57) ABSTRACT

A floating vessel with a buoyant hull for cargo, with a load line presentation device affixed to the buoyant hull without interrupting water flow along the buoyant hull the load line presentation device presenting: a baseline load line indicator plimsoll mark and a plurality of increased capacity load line indicator plimsoll marks, with an increased capacity model in memory connected to a processor in communication with the load line presentation device; the increased capacity model configured for automatically integrating a plurality of variables including: wave size, wave period, wind speed, surface current, vessel length, type of vessel, quantity of disconnected superstructures, quantity of sheer, and bow height and identifying increased capacity load line plimsoll mark for a voyage of the floating vessel, the load line presentation device displays the increased capacity load plimsoll mark improving baseline capacity of the buoyant hull from 1% to 30%.

10 Claims, 10 Drawing Sheets

FIG. 9

| Increased Capacity Model | | | |
|---|---|---|---|
| Factor | Deadweight | First Increased Capacity Load Line Indicator Plimsoll Mark | Second Increased Capacity Load Line Indicator Plimsoll Mark |
| Wave size (202) | 60 feet | 55 feet | 45 feet |
| Wave period (206) | 15 s | 13s | 11s |
| Wind speed (208) | 100 knots | 80 knots | 70 knots |
| Surface current (210) | 1.5 knots | 1.0 knots | .75 knots |
| Length overall (212) | 221 meters | 221 meters | 221 meters |
| Type of vessel (214) | Barge | Barge | Barge |
| Quantity of Disconnected Superstructure (216) | 2 | 2 | 2 |
| Quantity of Sheer (218) | Zero | Zero | Zero |
| Bow height (220) | 8 meters | 8 meters | 8 meters |

FLOATING VESSEL CARGO OPTIMIZATION SYSTEM

FIELD

The present embodiments generally relate to a floating vessel with a cargo optimization system.

BACKGROUND

A need exists for a device to safely increase floating vessel cargo capacity.

The present embodiments meet these needs.

BRIEF DESCRIPTION OF THE DRAWINGS

The detailed description will be better understood in conjunction with the accompanying drawings as follows:

FIG. 9 is a table showing a barge and the specific conditions that define use of a baseline load line plimsoll mark during a voyage and two increased capacity load line plimsoll marks.

Figure 1:
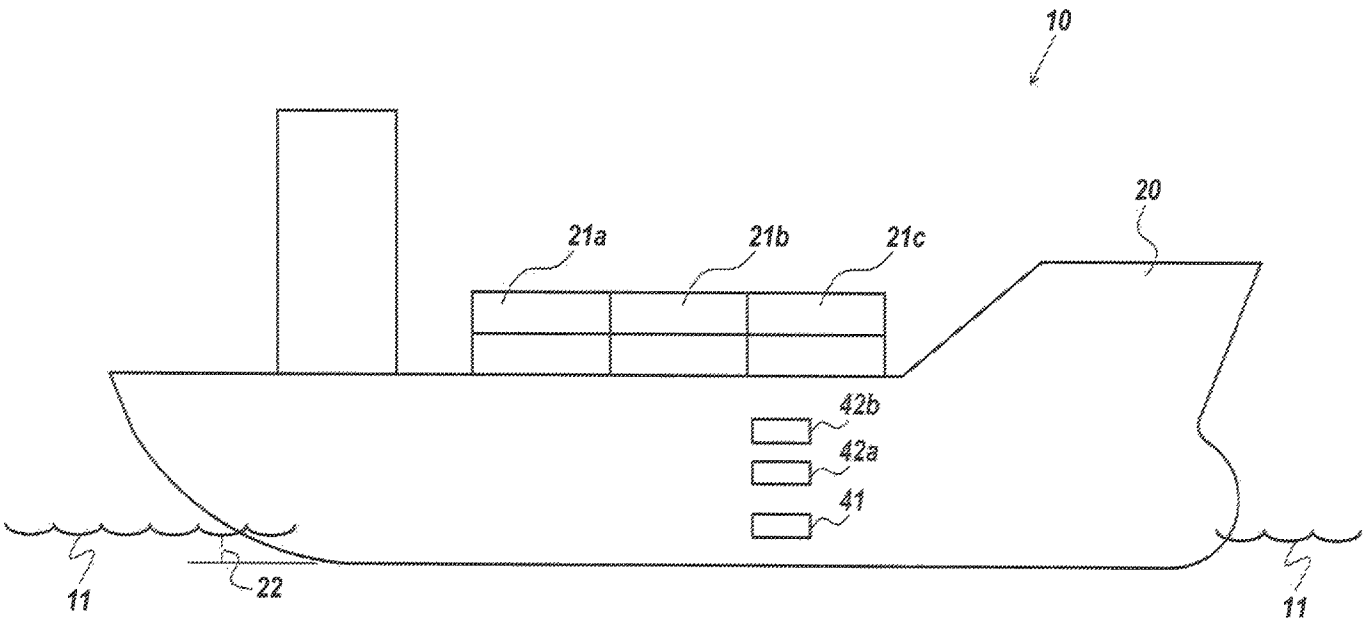
FIG. 1 depicts a side view of a floating vessel with multiple load line plimsoll marks.

The present embodiments are detailed below with reference to the listed Figures.

DETAILED DESCRIPTION OF THE EMBODIMENTS

Before explaining the present floating vessel in detail, it is to be understood that the floating vessel system is not limited to the particular embodiments and that it can be practiced or carried out in various ways.

The invention relates to a floating vessel with a buoyant hull for cargo.

The floating vessel has mounted to each side of the hull a load line presentation device positioned to avoid interrupting water flow along the buoyant hull.

The load line presentation device displays selectively a baseline load line indicator plimsoll mark or one of a plurality of increased capacity load line indicator plimsoll marks.

The increased capacity load line indicator marks are determined using an increased capacity model in memory connected to a processor in communication with the load presentation device.

The increased capacity model is configured for automatically integrating a plurality of variables, including information about the floating vessel, amount of cargo and information about the environment.

The increased capacity model identifies appropriate and safe increased capacity load line plimsoll marks for a voyage of the floating vessel.

The loadline presentation device allows for the display of the increased capacity load plimsoll marks improving baseline capacity of the buoyant hull from 1% to 30%.

A benefit of the invention is that it increases cargo carrying capacity of the vessel by 1 to 30%.

The invention reduces casualties during construction of vessels. 1% to 30% fewer vessels will be required as fewer ships can carry more goods, so the fatalities during construction of the vessels will be reduced by 1% to 30% as well.

In addition, the invention reduces death during vessel voyages. 1% to 30% fewer vessels will be required as fewer ships can carry more goods, so the fatalities during voyages of the vessels will be reduced by 1% to 30% as well. This technology does not require more people onboard the vessel during voyages so the total number of people required to move cargo will be reduced by 1% to 30% and all the numbers in between.

Death during vessel loading, unloading and maneuvering in port with tugs will be reduced as a result of this technology. 1% to 30% fewer vessels will be required as fewer ships can carry more goods, so the fatalities during loading, unloading and maneuvering in port of the vessels will be reduced by 1% to 30% as well. This technology does not require more people onboard the vessel during loading, unloading and maneuvering in port so the total number of people required to move cargo will be reduced by 1% to 30% and all the numbers in between.

Human harm during construction of vessels is reduced as a result of this technology. 1% to 30% fewer vessels will be required as fewer ships can carry more goods, so the human harm during construction of the vessels will be reduced by 1% to 30% and all the numbers in between.

Human harm during vessel voyages will be reduced as a result of this technology. 1% to 30% fewer vessels will be required as fewer ships can carry more goods, so the human harm during voyages of the vessels will be reduced by 1% to 30%. This technology does not require more people onboard the vessel during voyages so the total number of people required to move cargo we be reduced by 1% to 30% and all the numbers in between.

Human harm during vessel loading, unloading and maneuvering in port with tugs will be reduced as a result of this technology. 1% to 30% fewer vessels will be required as fewer ships can carry more goods, so the human harm during loading, unloading and maneuvering in port of the vessels will be reduced by 1% to 30% as well. This technology does not require more people onboard the vessel during loading, unloading and maneuvering in port so the total number of people required to move cargo we be reduced by 1% to 30% and all the numbers in between.

Spills of all types, toxic and non-toxic, during vessel voyages, loading, unloading and maneuvering in port will be reduced as a result of this technology. 1% to 30% fewer vessels will be required as fewer ships can carry more goods, so the spills during vessel voyages, loading, unloading and maneuvering in port will be reduced by 1% to 30% as well. By reducing the number of vessels required to move the same amount of toxic and non-toxic material the odds of vessels hitting another vessel or a stationary object decline.

This technology can be retrofitted to existing floating vessels, opening up the global commercial fleet to the benefits above. This can also be applied to new build vessels. The ability to apply this technology to nearly the entire commercial shipping fleet means the impact of the benefits will be far and wide.

The invention reduces fuel per baseline ton per unit of cargo transported. When carrying more cargo, with the increased capacity load line indicator plimsoll marks, the ship will use more fuel for the entire vessel, but the amount of fuel used per baseline ton of cargo will be less. This is because the incremental fuel from the baseline load line indicator plimsoll mark to the increase capacity load line indicator plimsoll marks will be less per unit than the baseline load line indicator plimsoll mark. Overall fuel consumption will be reduced as a result of this technology since between 1% and 30% less fuel will be required to transport the same amount of cargo.

The invention reduces energy costs by reducing the cost of transportation of crude oil, liquefied natural gas, refined petroleum products (like gasoline and diesel) coal, and wind and solar components.

A benefit of the invention is that it reduces nitrous oxide (NOX) emission per DWT/unit of cargo transported. When carrying more cargo in cases using the increased capacity load line indicator plimsoll mark, the vessel will produce more emission for the entire vessel, but the amount of emissions per baseline ton of cargo will be less because displacement vs. engine fuel consumption will be improved. This is because the incremental emissions from the baseline load line indicator plimsoll mark to increased capacity load line indicator plimsoll marks will be less than the baseline capacity load line indicator plimsoll mark and lowers the average.

The invention has the capacity to reduce the cost of goods at a destination by reducing the overall cost to move the goods.

The following definitions are used herein:

The term "buoyant hull" refers to a monohull, catamaran, or trimaran, or a column based hull. Examples of vessels with these hulls can be barges, cruise ships, container ships, and similar vessel classes.

The term "fresh water load line mark (F)" as used herein refers to a component of the load line mark which represents how much load a particular hull can accept in fresh water.

The term "increased capacity load line mark" refers to a modified plimsoll mark created by a user and approved by a vessel classification regulatory_society for use on the floating vessel.

The term "International Convention on Load Lines" refers to the International Convention on Load Lines signed in London 5 Apr. 1966 and it includes the amendments of the Protocol of 1988 relating to the International Convention on Load Lines, 1966 and revised as International Convention on Load Lines, 1966 and Protocol of 1988, as amended Consolidated edition, 2005 Supplement December 2013.

The term "baseline load line mark" as used herein refers to the plimsoll mark on the hull as defined under International Convention on Load Lines signed in London 5 Apr. 1966 amended by the 1988 Protocol and Amended Consolidated Edition 2005 Supplement December 2013.

The Term "Floating Vessel" includes Aframax, Capesize, Chinamax, Handymax (also known as Supramax), Handysize Malaccamax, Panamax, New Panamax, Q-Max, Seawaymax, Suezmax, Very Large Crude Carrier (VLCC), Ultra Large Crude Carrier (ULCC), Liquid Natural Gas Carrier (LNG), Bulk Carriers, General Cargo Carrier, Container Ship, Gas Carrier, Chemical Tanker, Ferry, Passenger Ships, Cruise Ships, Specialty Vessels, Mobil Offshore Drilling Unit (MODU), Oil Industry Vessels (pipe laying, seismic survey, accommodation vessels, etc.), Barge (many varieties), Offshore Supply Vessel, Floating Production Unit, and Roll On/Roll Off (RoRo), Fishing Vessels.

The term "increased capacity load line mark" as used herein refers to the increased capacity plimsoll mark whereby the floating vessel can accept additional cargo due to changes based on geographic location including local weather, current or wind.

The term "manual power" refers to a person flipping a switch with their finger or an arm, and no motor, or fluid or electricity being required.

The term "sheer" refers to a measure of longitudinal main deck curvature, in naval architecture. The upward curve formed by the main deck with reference to the level of the deck at the midship, is called sheer. It is usually given to allow flow of green water from the forward and aft ends to the midship and allow drainage to the bilges. The forward sheer is usually more than the aft sheer to protect the forward anchoring machinery from the waves. The sheer forward is usually twice that of sheer aft. Increases in the rise of the sheer forward and aft build volume into the hull, and in turn increase its buoyancy forward and aft, thereby keeping the ends from diving into an oncoming wave and slowing the ship. Sheer on exposed decks also makes a ship more seaworthy by raising the deck at fore and aft ends further from the water and by reducing the volume of water coming on deck.

The term "summer salt water load line mark (S)" as used herein refers to a component of the load line mark which represents how much load a particular hull can accept in salt water during summer months.

The term "tropical fresh water load line mark (TF)" as used herein refers to a component of the load line mark which represents how much load a particular hull can accept in tropical temperature fresh water.

The term "tropical salt water load line mark (T)" as used herein refers to a component of the load line mark which represents how much load a particular hull can accept in tropical temperature salt water.

The term "vessel classification regulatory society" refers to the American Bureau of Shipping, Bureau Veritas, Conarina, Germanischer Lloyd, Indian Register of Shipping, Biro Klasifikasi Indonesia. Lloyd's Register, Nippon Kaiji Kyokai, Det Norske Veritas, and Registro Italiano Navale.

The term "winter North Atlantic salt water load line mark (WNA)" as used herein refers to a component of the load line mark which represents how much load a particular hull can accept in salt water during winter months in the North Atlantic at less than or equal to 36 degrees latitude.

The term "winter salt water load line mark (W)" as used herein refers to a component of the load line mark which represents how much load a particular hull can accept in salt water during winter months.

Turning now to the Figures, FIG. 1 depicts a side view of a floating vessel with multiple load line plimsoll marks.

The invention relates to a floating vessel 10 in water 11 with a buoyant hull 20 for cargo 21*a*-21*c*.

The ship can be a tanker, a cargo ship, a car carrier, or any number of floating vessels that load cargo, transport cargo, and offload cargo. In embodiments, the floating vessels can be liquefied natural gas carriers.

The buoyant hull has a draft 22. In embodiments, the buoyant hull has a propulsion system or an on board dynamic positioning system or combinations thereof.

The buoyant hull 20 is required under the International Convention on Load Lines signed in London, England, 5 Apr. 1966 amended by the Protocol of 1988 relating to the International Convention on Load Lines, 1966 and revised as International Convention on Load Lines, 1966 and Protocol of 1988, as amended Consolidated edition, 2005 Supplement December 2013 to display a unique, load line indicator plimsoll mark 41, recognized by a vessel classification regulatory society.

On the side of the floating vessel is a baseline load line indicator plimsoll mark 41 representing an unrestricted service criteria for the floating vessel.

Each baseline load line indicator plimsoll mark is approved and issued by a vessel classification regulatory society, such as Lloyds of London™.

A plurality of increase capacity load line indicator plimsoll marks 42*a* and 42*b* can be installed on the side of the floating vessel, but only one can be visible at a time.

Figure 2A:
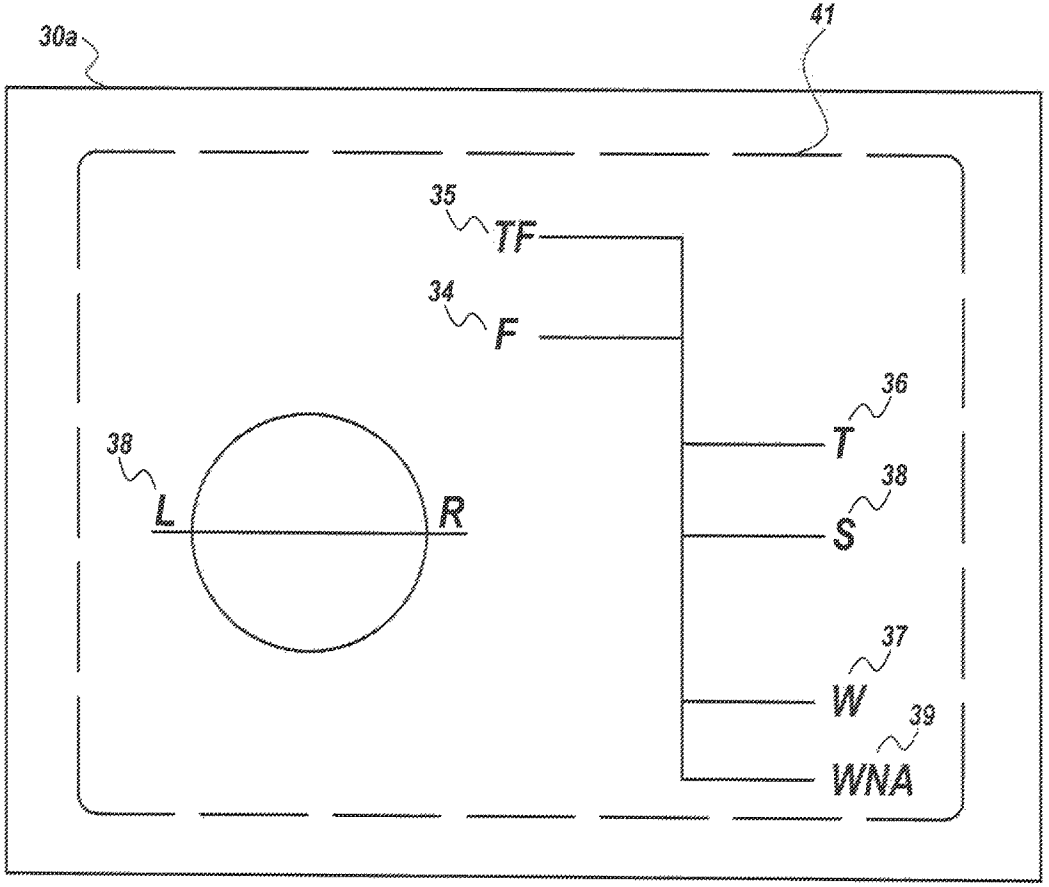
FIG. 2A depicts a detail of a baseline load line plimsoll mark.

FIG. 2A depicts a detail of a baseline load line plimsoll mark.

The invention includes a load line presentation device 30*a* affixed to the side of the buoyant hull 20 without interrupting water flow along the buoyant hull.

The load line presentation device presents a baseline load line indicator plimsoll mark 41 that includes a fresh water load line mark 34; a tropical fresh water load line mark 35; a tropical salt water load line mark 36; a winter salt water load line mark 37; a summer salt water load line mark 38; and a winter North Atlantic salt water load line mark 39.

Figure 2B:
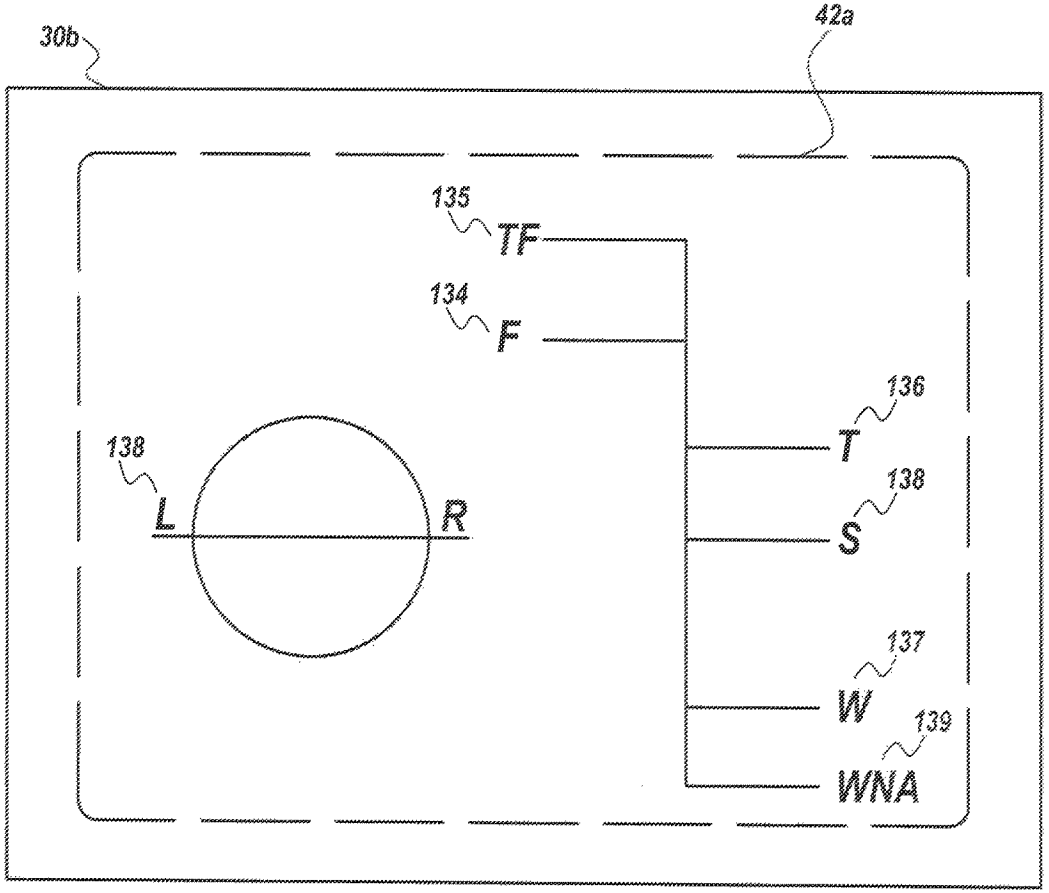
FIG. 2B depicts a detail of an increase capacity load line plimsoll mark according to the invention.

FIG. 2B depicts a detail of an increase capacity load line plimsoll mark as shown in FIG. 1.

FIG. 2B shows an increase capacity load line indicator plimsoll marks 42*a* installed on a load line presentation device 30*b*.

Each increased capacity load line plimsoll mark has a fresh water load line mark 134; a tropical fresh water load line mark 135; a tropical salt water load line mark 136; a winter salt water load line mark 137; a summer salt water load line mark 138; and a winter North Atlantic salt water load line mark 139.

Figure 3A:
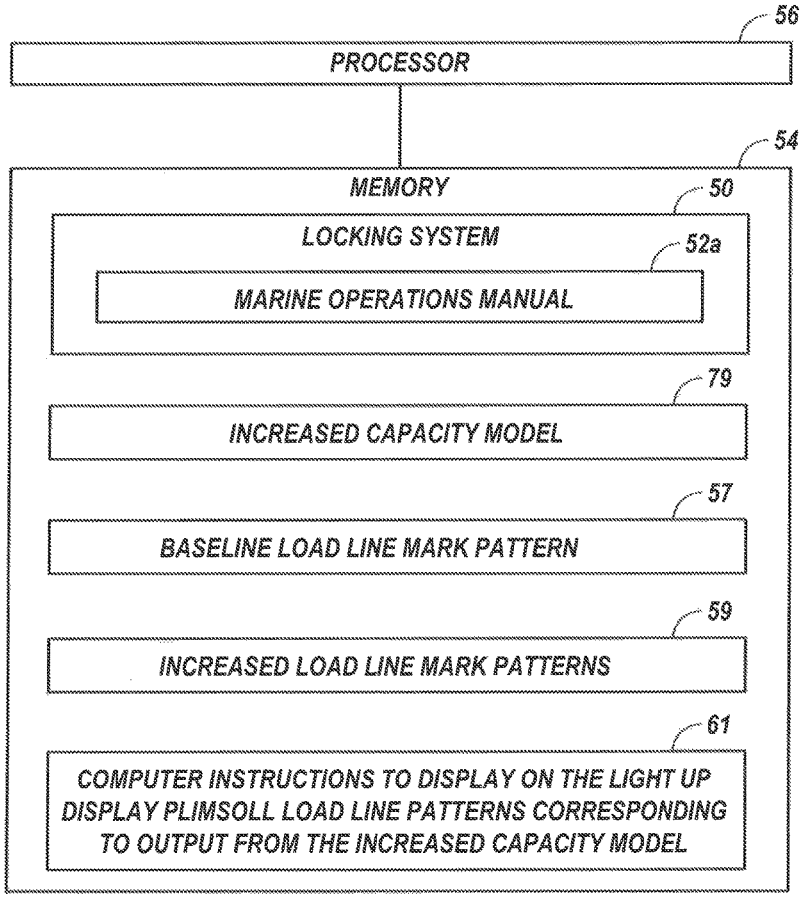
FIGS. 3A and 3B depict two mechanisms to isolate a marine operations manual according to the invention.
Figure 3B:
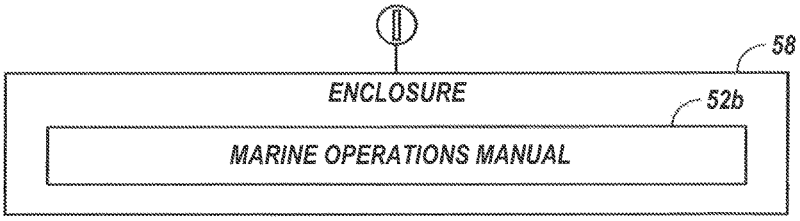

FIGS. 3A and 3B depict two mechanisms to isolate a marine operations manual according to the invention when an increased capacity load line plimsoll mark is used.

FIG. 3A shows a locking system 50 preventing access to a marine operations manual (MOM) 52*a* for loading, carrying, and offloading cargo using only the baseline load line plimsoll mark.

The marine operations manual 52*a* can be computer instructions in memory 54 connected to a processor 56 or as shown in FIG. 3B, the locking mechanism can be an enclosure 58 containing a printed marine operations manual 52*b* in a locking enclosure 58.

FIG. 3A also depicts the increased capacity model 79, as well as baseline load line mark pattern 57 and increase load line mark pattern 59. The last two patterns are used by the processor to illuminate a display on the side of the buoyant hull to depict a desired increased capacity or baseline load line mark.

Figure 4A:
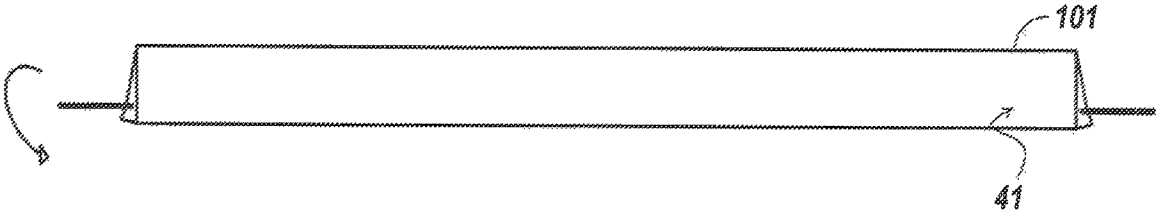
FIGS. 4A and 4B depict two different sides of load line presentation device with a baseline load line plimsoll mark and an increased capacity load line plimsoll mark.
Figure 4B:
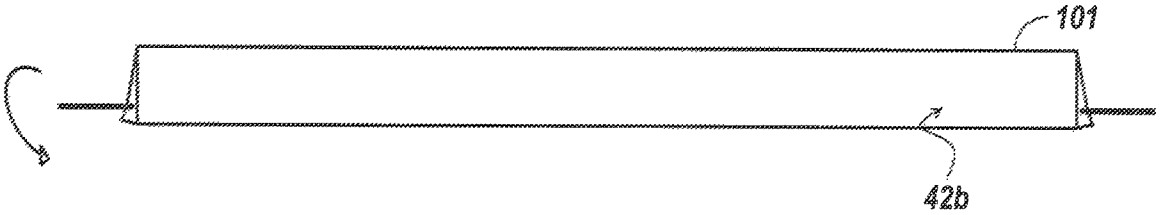

FIGS. 4A and 4B depict two different sides of load line presentation device with a baseline load line plimsoll mark 41 and an increased capacity load line plimsoll mark 42*b*.

The load line presentation device is a pivoting display device 101 attached to the buoyant hull wherein different sides of the pivoting display device show either a permanently affixed baseline load line indicator plimsoll mark 41 or one of two permanently affixed increased capacity load line indicator plimsoll marks, wherein mark 42*b* is presented.

Figure 5C:
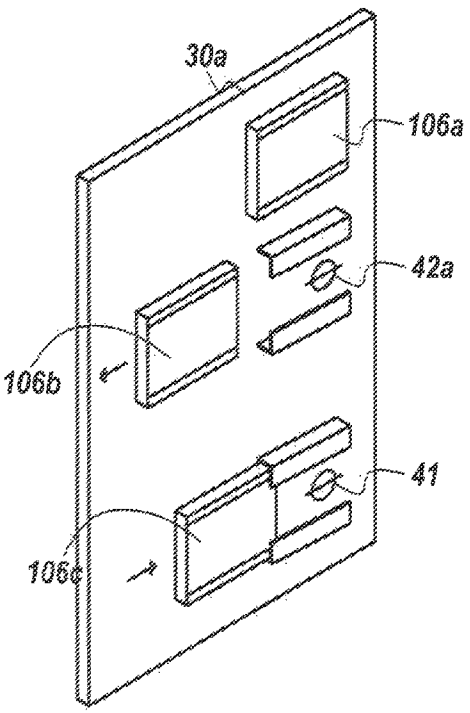
FIGS. 5A, 5B and 5C show three different embodiments of a load line presentation device with a baseline load line plimsoll mark and a plurality of increased capacity load line plimsoll marks.
Figure 5B:
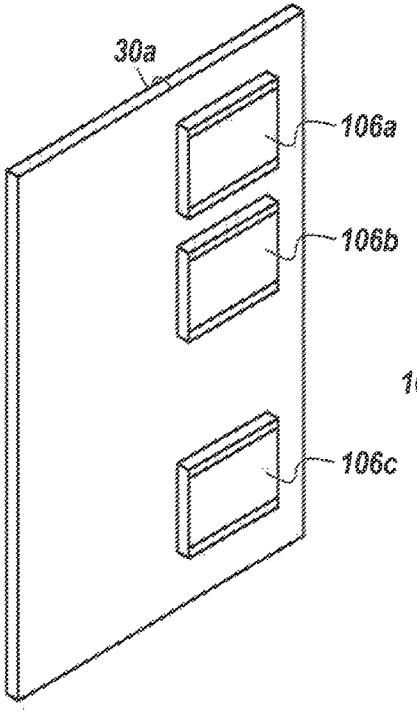
Figure 5A:
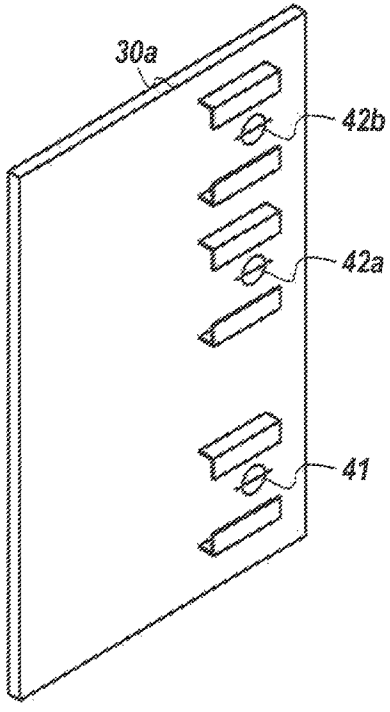
Figure 6A:
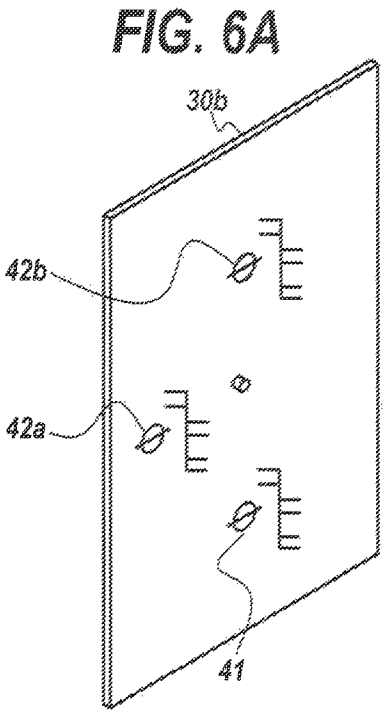
FIGS. 6A, 6B, 6C and 6D depict four plimsoll marks of a load line presentation device including a baseline load line plimsoll mark and a plurality of increased capacity load line plimsoll marks.
Figure 6B:
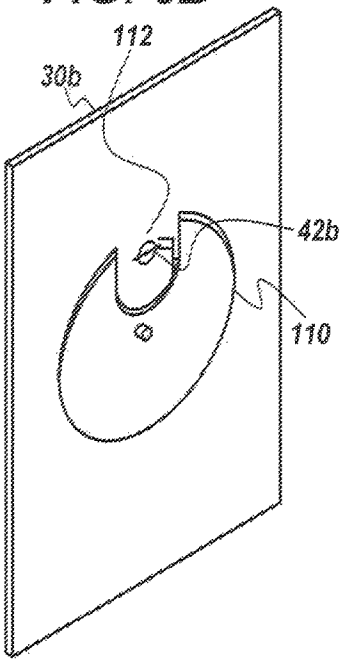
Figure 6C:
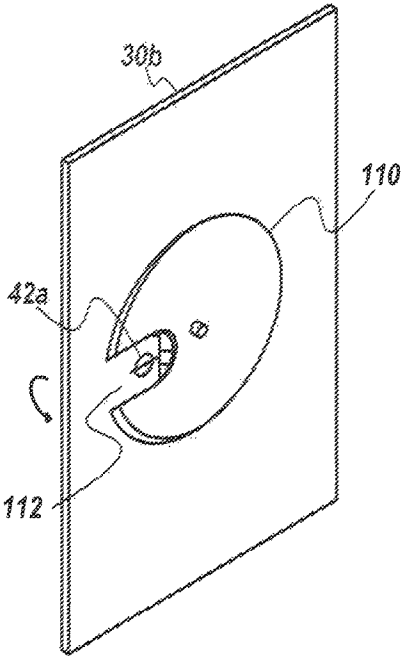
Figure 6D:
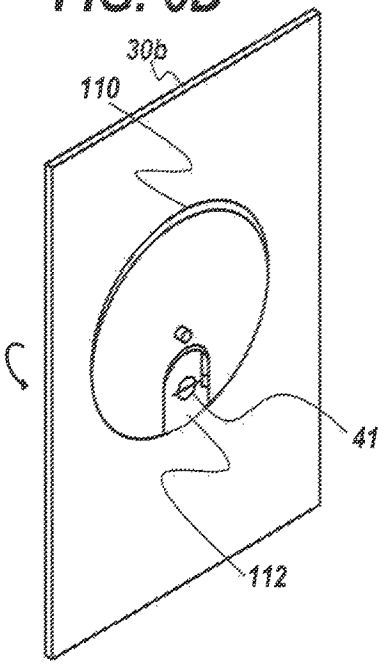
Figure 7A:
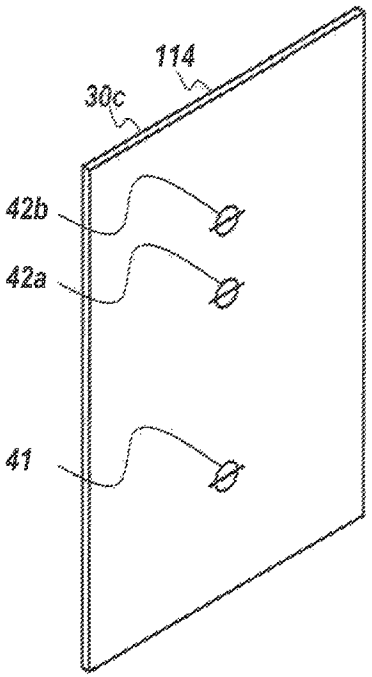
FIGS. 7A, 7B, 7C and 7D depict an electronic display presenting electrically a baseline load line plimsoll mark or one of a group of increased capacity load line plimsoll marks.
Figure 7B:
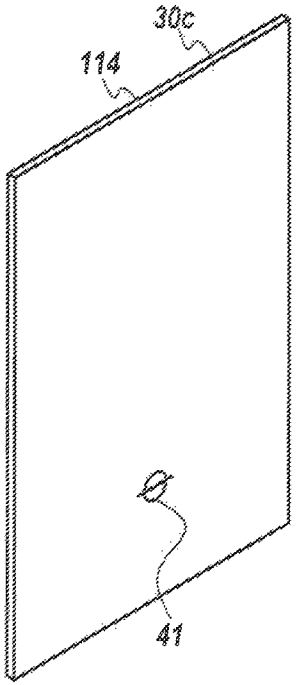
Figure 7C:
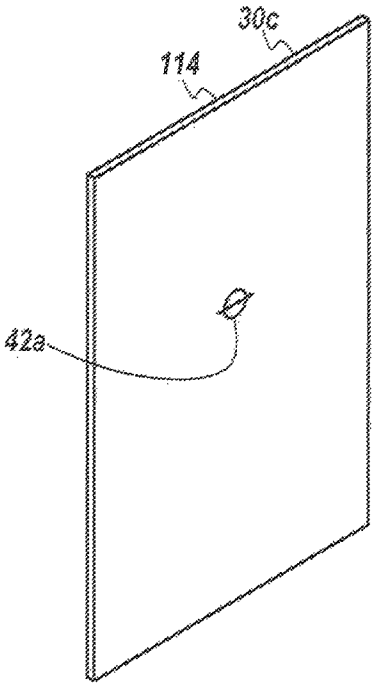
Figure 7D:
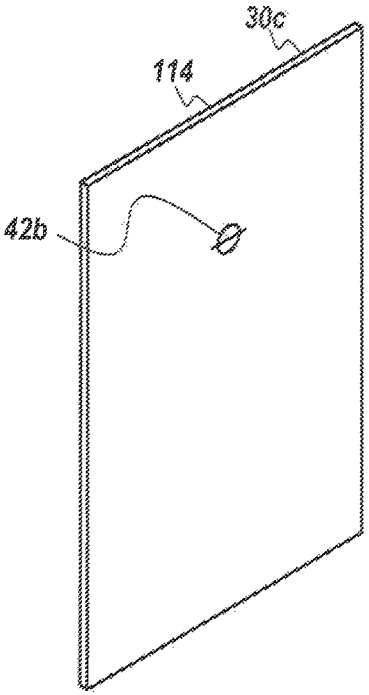

FIGS. 5A, 5B and 5C show three different embodiments of a load line presentation device with a baseline load line plimsoll mark 41 and a plurality of increased capacity load line plimsoll marks 42*ab*.

In these three Figures, the load line presentation device 30*a* has three sleeves 106*a*, 106*b* and 106*c* which can selectively slide to reveal or hide a plimsoll mark.

The sliding sleeve 106*c* can selectively show a permanently affixed baseline load line indicator plimsoll mark 41.

The sliding sleeves 106*b* and 106*a* can selectively show permanently affixed increased capacity load line indicator plimsoll marks 42*b* and 42*a*, respectively.

FIGS. 6A, 6B, 6C, and 6D depict four plimsoll marks of a load line presentation device 30*b* including a baseline load line plimsoll mark and a plurality of increased capacity load line plimsoll marks.

In these Figures, the load line presentation device is a rotating wheel 110 mounted to a substructure, with the rotating wheel 110 having a window 112.

The rotating wheel 110 is configured to turn and enable the window 112 to selectively present a baseline load line plimsoll mark 41 or alternatively increased capacity load line plimsoll marks 42*a* or 42*b*.

FIGS. 7A, 7B, 7C, and 7D depict an electronic display presenting an illuminated baseline load line plimsoll mark or one of a group of increased capacity load line plimsoll marks.

This load line presentation device 30*c* can be a light up electric display 114.

The light up electric display 114 connects to the processor with memory.

The memory contains baseline plimsoll load line mark patterns and increased capacity load line plimsoll mark patterns.

The memory includes computer instructions to instruct the processor to display on the light up electric display plimsoll load line mark patterns corresponding to output from the increased capacity model.

In the embodiments, it is contemplated that the light up electronic display 114 is viewable for at least 200 yards from the floating vessel in clear weather.

In the embodiments, the light up electronic display has a length from 6 feet to 10 feet and a height from 6 feet to 10 feet and engages onboard floating vessel power.

Figure 8:
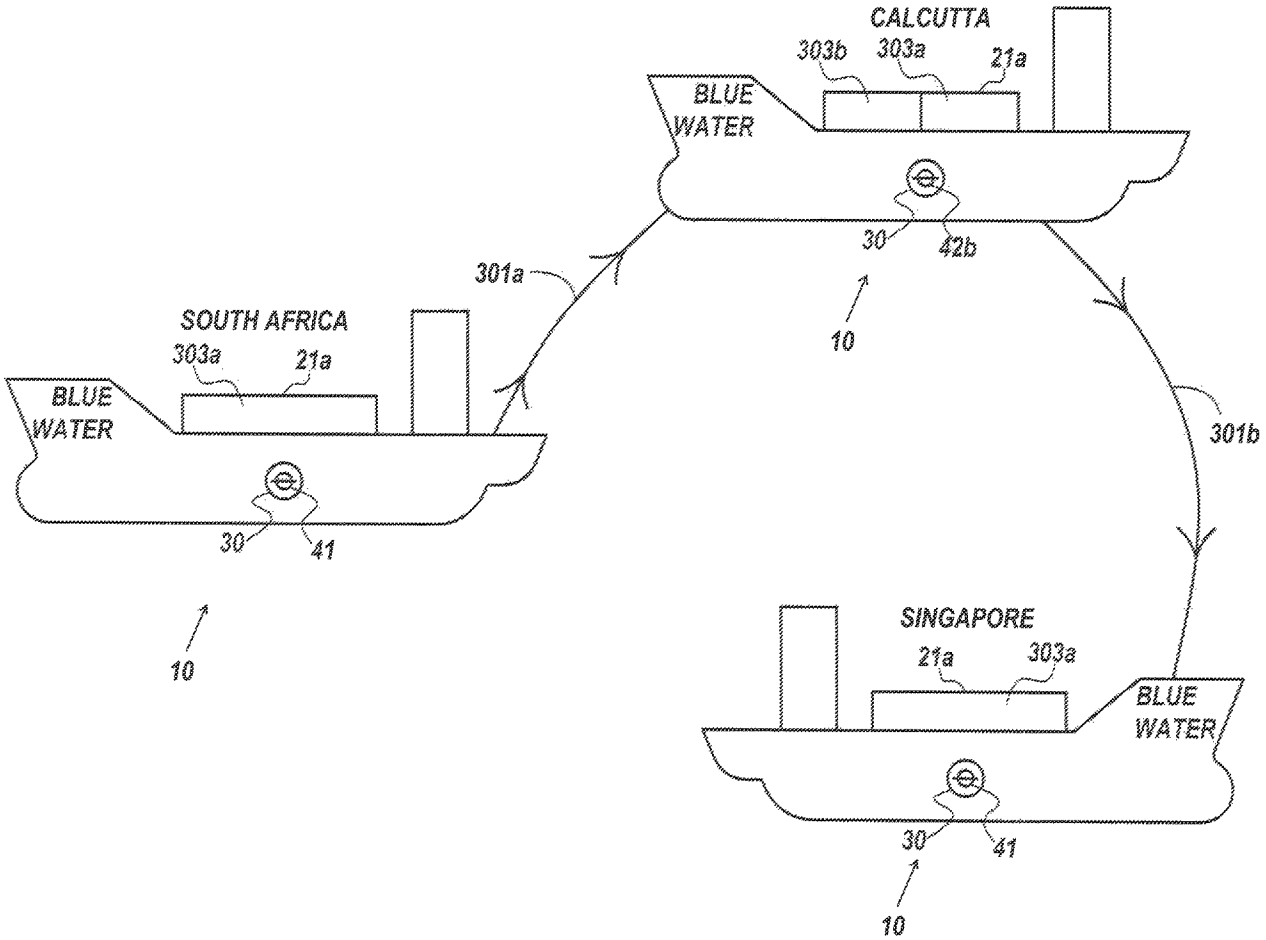
FIG. 8 depicts the load line plimsoll mark according to one or more embodiments.

FIG. 8 depicts a floating vessel on a 2-stage voyage, with the first stage having a baseline cargo and the plimsoll mark displayed corresponding to the baseline case and the second leg having a different cargo, greater than the cargo for leg 1, and the plimsoll mark corresponding to a higher capacity.

In the embodiments, using the processor and memory, load line presentation device 30 automatically changes a baseline load line plimsoll mark to correspond to environmental criteria and instructions from the increased capacity model based on a navigation route 301*ab* and based on weights 303*ab* of cargo 21*a* loaded and offloaded along the navigation route 301*ab*.

FIG. 8 depicts a ship, the "Bluewater" traversing from South Africa with bad weather to Calcutta with mild weather to Singapore.

The load line presentation device 30 in South Africa is set at the baseline load line plimsoll mark 41 with cargo 21*a* having a first weight 303*a* of 10,000 tons.

The floating vessels traverses navigation route 301*a*.

In Calcutta, the floating vessel changes the plimsoll mark to an increased capacity plimsoll mark 42*b* and takes on additional cargo weighing an addition 10,000 tons noted as weight 303*b*.

The changed mark is calculated by the increased capacity model using the processor in an on board computer, or using cloud computing.

The increased capacity plimsoll marks are pre-calculated and pre-approved.

The changed mark corresponds to environmental criteria modified in the increased capacity model based on a navigation route 301*b* and based on weights 303*a* and 303*b* of cargo 21*a* loaded along the navigation route 301

The floating vessel 10 reaches Singapore and offloads, and changes the plimsoll mark back to a baseline load line indicator plimsoll mark 41.

FIG. 9 is a table showing the increased capacity model for a barge and the specific conditions that define use of a baseline load line plimsoll mark 41 during a voyage and two increased capacity load line plimsoll marks 42*a*, and 42*b*.

The invention includes an increased capacity model 79 located in memory 54 and connected to a processor 56 which in turn is in communication with the load line presentation device 30.

The increased capacity model 79 is configured for automatically integrating at least four of the plurality of variables shown in the table of FIG. 9.

Those variables include: a wave size 202, a wave period 206, a wind speed 208, a surface current (in knots) 210, a length overall (of the buoyant hull) 212, a type of floating vessel 214, a quantity of disconnected superstructures (mounted to the buoyant hull) 216, a quantity of sheer (in degrees) 218, and a bow height 220 of the buoyant hull as measured from a keel and identifying increased capacity load line plimsoll mark for a voyage of the floating vessel.

For a type of floating vessel that is a barge (labelled as element 214) has a length over all (LOA) of 221 meters (shown as element 212), the baseline load line indicator plimsoll mark 41 is shown in FIG. 9 which was computed based on: a wave size 202 is 20 feet, a wave period 206 is 15 seconds, a wind speed 208 is 100 knots, a surface current 210 is 1.5 knots, a quantity of disconnected superstructures (mounted to the barge) is labelled as element 216, the sheer value of the barge hull (in feet sustainable by the buoyant hull without deforming) is zero and labelled as element 218, and the barge bow height is 8 meters, which is labelled as element 220.

For the same barge, a first increased capacity load line indicator plimsoll mark 42*a*: is selected using a wave size 202 of 55 feet, a wave period 206 of 13 seconds, a wind speed 208 of 80 knots, a surface current 210 of 1.0 knot, a quantity of disconnected superstructures (mounted to the barge) is still two 216, the sheer value of the barge hull (in feet sustainable by the buoyant hull without deforming) remains zero and 218, and the barge bow height is still 8 meters, element 220.

For the same barge, a second increased capacity load line indicator plimsoll mark 42*b*: is selected using a wave size 202 of 15 feet, a wave period 206 of 11 seconds, a wind speed 208 of 70 knots, a surface current 210 of 0.75 knots, a quantity of disconnected superstructures (mounted to the barge) is still two 216, the sheer value of the barge hull (in degrees sustainable by the buoyant hull without deforming) remains zero and 218, and the barge bow height is still 8 meters, element 220.

The increased capacity model displays a calculated increase capacity load line plimsoll mark for use on the load line presentation device 30*a*.

When the increased capacity model 79 indicates the baseline load line indicator plimsoll mark can be hidden and an increase capacity load line plimsoll mark can be used, the load line presentation device displays the increased capacity load plimsoll mark improving baseline capacity of the buoyant hull from 1% to 30%.

In embodiments, the load line presentation device is operable by electric power, hydraulic power, pneumatic power, manual power, and combinations thereof.

In embodiments, the load line presentation device 30 automatically changes a maximum amount of cargo depending on the plimsoll mark that is applicable based on a navigation route 301*ab*.

EXAMPLE

A barge in sea water in summer is traversing between Dubai and Singapore.

The barge has a displacement of 11,000 baseline tons, a length overall of 220 meters, a beam of 40 meters, and a draft of 5 meters.

The buoyant hull of the barge is hauling cargo tubular steel.

The barge is required under International Convention on Load Lines signed in London, England, 5 Apr. 1966 amended by the Protocol of 1988 Relating to the International Convention on Load Lines, 1966 and Revised as International Convention on Load Lines, 1966 and Protocol of 1988 as amended Consolidated Edition, 2005 Supplement December 2013 to display corresponding to a baseline load line indicator plimsoll mark approved by American Bureau of Shipping (ABS).

A load line presentation device that is a rotating disc with window affixed to the buoyant hull without interrupting water flow along the buoyant hull.

In one window, the load line presentation device presents the baseline load line indicator plimsoll mark representing an unrestricted service criteria.

The baseline load line indicator plimsoll mark has a fresh water load line mark (F); a tropical fresh water load line mark (TF), a tropical salt water load line mark (T); a winter salt water load line mark (W); a summer salt water load line mark (S); and a winter North Atlantic salt water load line mark (WNA).

For this barge, the load line presentation device presents two increased capacity load line indicator plimsoll marks.

Each increased capacity load line plimsoll mark has a fresh water load line mark (F); a tropical fresh water load line mark (TF), a tropical salt water load line mark (T); a winter salt water load line mark (W); a summer salt water load line mark (S); and a winter North Atlantic salt water load line mark (WNA).

On the barge is a processor with memory in communication with the load presentation device. The memory contains known information about the barge.

In memory is an increased capacity model, a length over all of the buoyant hull of the barge, the type of floating vessel (a barge), a quantity of disconnected superstructures mounted to the buoyant hull (one), a quantity of sheer, and a bow height of the buoyant hull as measured from a keel (8 meters).

The increased capacity model is configured to automatically integrate the known information on the buoyant hull stored in memory with a maximum expected wave size to be encountered on the next voyage, a maximum wave period expected to be encountered on the next voyage, a maximum wind speed expected to be encountered on the next voyage, and a maximum surface current in knots expected to be encountered on the next voyage.

The increased capacity model computes increased capacity load line plimsoll marks possible for use in different zones having different environmental criterial throughout the voyage of the barge.

The onboard model computes which one of the possible plimsoll marks available for display by the load line mark display device is applicable.

The increased capacity model displays the calculated increase capacity load line plimsoll mark for use on the load line presentation device.

The load line presentation device is rotated to present through the window of the load line presentation device the corresponding increased capacity load line plimsoll mark identified by the increased capacity model.

The baseline load line indicator plimsoll mark is hidden and the barge now has an increased cargo capacity beyond the baseline capacity of the barge of 5% for this voyage.

While these embodiments have been described with emphasis on the embodiments, it should be understood that within the scope of the appended claims, the embodiments might be practiced other than as specifically described herein.

What is claimed is:

1. A floating vessel in water comprising:

a. a buoyant hull for cargo, the buoyant hull having a draft, wherein the buoyant hull is required under International Convention on Load Lines 1966 signed in London, England, 5 Apr. 1966 amended by Protocol of 1988 relating to the International Convention on Load Lines, 1966 and revised as International Convention on Load Lines, 1966 and Protocol of 1988, as amended Consolidated edition, 2005 Supplement December 2013 to display of baseline load line indicator plimsoll mark;

b. at least one load line presentation device affixed to the buoyant hull without interrupting water flow along the buoyant hull the load line presentation device presenting:

i. a baseline load line indicator plimsoll mark representing an unrestricted service criteria, each baseline load line indicator plimsoll mark approved and issued by a vessel classification regulatory society further comprising:

(a) a fresh water load line mark;

(b) a tropical fresh water load line mark;

(c) a tropical salt water load line mark;

(d) a winter salt water load line mark;

(e) a summer salt water load line mark; and (f) a winter North Atlantic salt water load line mark; and ii. a plurality of increased capacity load line indicator plimsoll marks each increased capacity load line plimsoll mark comprising:

(a) a fresh water load line mark;

(b) a tropical fresh water load line mark;

(c) a tropical salt water load line mark;

(d) a winter salt water load line mark;

(e) a summer salt water load line mark; and (f) a winter North Atlantic salt water load line mark;

c. an increased capacity model in memory connected to a processor in communication with the load presentation device, the increased capacity model configured for automatically integrating a plurality of variables including at least four of: a wave size, a wave period, a wind speed, a surface current, a length over all (of the buoyant hull), a type of floating vessel a quantity of disconnected superstructures (mounted to the buoyant hull), sheer value (in degrees sustainable by the buoyant hull without deforming), and a bow height of the buoyant hull as measured from a keel and identifying increased capacity load line plimsoll mark for a voyage of the floating vessel, and wherein the increased capacity model displays a calculated increase capacity load line plimsoll mark for use on the load line presentation device; and when the increased capacity model indicates the baseline load line indicator plimsoll mark can be hidden and an increased capacity load line plimsoll mark can be used, the load line presentation device displays the increased capacity load plimsoll mark improving baseline capacity of the buoyant hull from 1% to 30%;

wherein the load line presentation device automatically changes which of the pre-calculated plimsoll marks is displayed, based on the environmental criteria, based on a navigation route and based on weights of cargo loaded and offloaded along the navigation route.

2. The floating vessel of claim 1, comprising a locking system preventing access to a marine operations manual (MOM) for loading, carrying, and offloading cargo using only the baseline load line plimsoll mark, wherein the marine operations manual can be computer instructions in memory connected to a processor or printed marine operations manual in a locking enclosure.

3. The floating vessel of claim 1, wherein the load line presentation device is operable by electric power, hydraulic power, pneumatic power, manual power, or combinations thereof.

4. The floating vessel of claim 1, wherein the load line presentation device is a pivoting display device attached to the buoyant hull and different sides of the pivoting display device show a permanently affixed baseline load line indicator plimsoll mark and a plurality of increased capacity load line indicator plimsoll marks.

5. The floating vessel of claim 1, wherein the load line presentation device has a sleeve and the sliding sleeve selectively shows a permanently affixed baseline load line indicator plimsoll mark or the plurality of increased capacity load line indicator plimsoll marks.

6. The floating vessel of claim 1, wherein the load line presentation device is a rotating wheel with a window wherein the rotating wheel is configured to enable the window to selectively present a baseline load line plimsoll mark or a plurality of increased capacity load line plimsoll marks.

7. The floating vessel of claim 1, wherein the load line presentation device is a light up electric display.

8. The floating vessel of claim 7, wherein the light-up electric display has a second processor with memory, the memory containing baseline plimsoll load line mark patterns and increased capacity load line plimsoll mark patterns and computer instructions to instruct the processor to display on the light-up electric display plimsoll load line mark patterns corresponding output from the increased capacity model.

9. The floating vessel of claim 7, wherein the light-up electronic display is viewable for at least 200 yards from the floating vessel in clear weather.

10. The floating vessel of claim 7, wherein the light-up electronic display has a length from 6 feet to 10 feet and a height from 6 feet to 10 feet and engages onboard floating vessel power.

* * * * *